US010828214B2

(12) United States Patent
Bogli et al.

(10) Patent No.: US 10,828,214 B2
(45) Date of Patent: Nov. 10, 2020

(54) STAND-UP UNIT WITH HIP FLEX FOR WHEELCHAIRS AND OTHER DEVICES

(71) Applicant: Dane Technologies, Inc., Maple Grove, MN (US)

(72) Inventors: Heinz Bogli, Wohlen (CH); Fabian Wolter, Oberrohrdorf (CH); Dan Johnson, Medina, MN (US)

(73) Assignee: Dane Technologies, Inc., Maple Grove, MN (US)

( * ) Notice: Subject to any disclaimer, the term of this patent is extended or adjusted under 35 U.S.C. 154(b) by 51 days.

(21) Appl. No.: 16/150,025

(22) Filed: Oct. 2, 2018

(65) Prior Publication Data

US 2019/0099308 A1 Apr. 4, 2019

Related U.S. Application Data

(60) Provisional application No. 62/566,990, filed on Oct. 2, 2017.

(51) Int. Cl.
*A61G 5/14* (2006.01)
*A61G 5/12* (2006.01)

(52) U.S. Cl.
CPC ..... *A61G 5/14* (2013.01); *A61G 5/128* (2016.11)

(58) Field of Classification Search
CPC ..... A61G 5/14; A61G 5/128
USPC ..... 280/304.1
See application file for complete search history.

(56) References Cited

U.S. PATENT DOCUMENTS

| | | | | |
|---|---|---|---|---|
| 7,887,133 | B2 * | 2/2011 | Perk | A61G 5/10 297/344.15 |
| 8,403,352 | B2 * | 3/2013 | Hunziker | A61G 5/14 280/304.1 |
| 8,844,961 | B2 * | 9/2014 | Hunziker | A61G 5/14 280/304.1 |
| 8,870,216 | B2 * | 10/2014 | Maurer | A61G 5/1067 280/657 |
| 9,351,891 | B2 * | 5/2016 | Maurer | A61G 5/1067 |
| 9,375,372 | B2 * | 6/2016 | Hunziker | A61G 5/14 |
| 9,757,291 | B2 * | 9/2017 | Hunziker | A61G 5/14 |
| 9,867,747 | B2 * | 1/2018 | Maurer | A61G 5/1067 |
| 2003/0015853 | A1 * | 1/2003 | Hanson | A61G 5/006 280/250.1 |
| 2007/0063480 | A1 | 3/2007 | Porcheron | |
| 2007/0296177 | A1 * | 12/2007 | Porcheron | A61G 5/14 280/250.1 |
| 2013/0278032 | A1 | 10/2013 | Hunziker | |
| 2016/0302984 | A1 | 10/2016 | Hunziker | |
| 2018/0185215 | A1 * | 7/2018 | Brown | A61G 5/1075 |

* cited by examiner

*Primary Examiner* — Jacob D Knutson
(74) *Attorney, Agent, or Firm* — Davis, Brown, Koehn, Shors & Roberts, P.C.; Sean D. Solberg

(57) ABSTRACT

Disclosed herein is a stand-up unit having a parallelogram and a hinged lever that is coupled to the parallelogram and to the seat such that the seat is disposed at an angle in relation to the seat as the parallelogram moves toward the standing position. Disclosed also are wheelchairs, therapy chairs, and other devices or apparatuses that can incorporate the stand-in unit for purposes of assisting a user in moving from a sitting to a standing position.

20 Claims, 6 Drawing Sheets

STAND-UP UNIT WITH HIP FLEX FOR WHEELCHAIRS AND OTHER DEVICES

CROSS-REFERENCE TO RELATED APPLICATION(S)

This application claims the benefit under 35 U.S.C. § 119(e) to U.S. Provisional Application 62/566,990, filed Oct. 2, 2018 and entitled "Stand-Up Unit with Hip Flex for Wheelchairs and Other Devices," which is hereby incorporated herein by reference in its entirety.

FIELD OF THE INVENTION

The embodiments herein relate to stand-up units that are designed to move a user between a sitting position and a standing position. Stand-up units can be used, for example, in stand-up wheelchairs, therapy chairs, and the like.

BACKGROUND OF THE INVENTION

Certain known stand-up systems provide for the backrest to remain upright both in the sitting and standing configurations. Further, such systems provide both sitting and standing configurations and movement between those two configurations such that almost no relative movement occurs between the upper legs of the user and the seat and between the back of the user and the backrest as the user stands up and sits down, thereby reducing or eliminating shear forces from such relative movement, which reduces or eliminates decubitus in the user.

One disadvantage of such known stand-up units is that, when they move into the standing position, the seat and backrest move into a single plane of support against which the user is disposed. This single plane of support creates an unnatural standing position for the user.

There is a need in the art for improved stand-up units and related systems and methods.

BRIEF SUMMARY OF THE INVENTION

Discussed herein are various stand-up units for use in any devices that provide assistance to a user in moving between a sitting position and a standing position, including stand-up units that provide for a tilt in the seat as the unit moves toward the standing position, thereby allowing for the user to be positioned in the standing position with the natural hip tilt typically exhibited when standing.

In Example 1, a stand-up unit comprises a parallelogram comprising first and second elongate levers and first and second connecting levers, a hinged lever, a seat comprising a coupling track operably coupled to the seat, and a support operably coupled to the second connecting lever, wherein the coupling structure is slidably coupled to the coupling track. The hinged lever comprises a first link, a second link rotatably coupled to the first link at a hinged lever joint, and a coupling structure attached to the second link, wherein the first link is rotatably coupled to the first connecting lever.

Example 2 relates to the stand-up unit according to Example 1, wherein the parallelogram comprises a sitting position and a standing position, wherein the parallelogram is moveable between the sitting and standing positions.

Example 3 relates to the stand-up unit according to Example 2, wherein the seat is substantially parallel with the first elongate lever in the sitting position.

Example 4 relates to the stand-up unit according to Example 3, wherein the seat is disposed at an angle in relation to the first elongate lever in the standing position, wherein the seat being disposed at the angle allows a user to stand with a natural hip tilt.

Example 5 relates to the stand-up unit according to Example 2, wherein the coupling structure is disposed at or near a proximal end of the coupling track when the parallelogram is in the sitting position.

Example 6 relates to the stand-up unit according to Example 5, wherein the seat is substantially parallel with the first elongate lever in the sitting position as a result of the coupling structure being disposed at or near the proximal end of the coupling track.

Example 7 relates to the stand-up unit according to Example 2, wherein the coupling structure is disposed at or near a distal end of the coupling track when the parallelogram is in the standing position.

Example 8 relates to the stand-up unit according to Example 7, wherein the seat is disposed at an angle in relation to the first elongate lever in the standing position as a result of the coupling structure being disposed at or near the distal end of the coupling track.

Example 9 relates to the stand-up unit according to Example 1, wherein the stand-up unit is incorporated into a wheelchair or a therapy chair.

In Example 10, a stand-up unit comprises a parallelogram comprising upper and lower elongate levers and front and rear connecting levers, wherein the parallelogram is moveable between a sitting position and a standing position, a two-piece coupling lever, a seat comprising an elongate coupling track fixedly attached at a proximal portion of the seat, wherein the coupling structure is moveably coupled to the elongate coupling track such that the coupling structure can move along a length of the elongate coupling track, and a support operably coupled to the front connecting lever. The two-piece coupling lever comprises a first link comprising a first end and a second end, wherein the first link is rotatably coupled to the rear connecting lever at the first end of the first link, a second link comprising a first end and a second end, a rotatable joint disposed at the second end of the first link and the second end of the second link, such that the first and second links are rotatably coupled via the rotatable joint, and a coupling structure attached to the first end of second link.

Example 11 relates to the stand-up unit according to Example 10, wherein the seat is substantially parallel with the upper elongate lever in the sitting position.

Example 12 relates to the stand-up unit according to Example 10, wherein the seat is disposed at an angle in relation to the upper elongate lever in the standing position, wherein the seat being disposed at the angle allows a user to stand with a natural hip tilt.

Example 13 relates to the stand-up unit according to Example 10, wherein the coupling structure is disposed at or near a proximal end of the elongate coupling track when the parallelogram is in the sitting position.

Example 14 relates to the stand-up unit according to Example 13, wherein the seat is substantially parallel with the upper elongate lever in the sitting position as a result of the coupling structure being disposed at or near the proximal end of the elongate coupling track.

Example 15 relates to the stand-up unit according to Example 10, wherein the coupling structure is disposed at or near a distal end of the elongate coupling track when the parallelogram is in the standing position.

Example 16 relates to the stand-up unit according to Example 15, wherein the seat is disposed at an angle in relation to the upper elongate lever in the standing position as a result of the coupling structure being disposed at or near the distal end of the elongate coupling track.

In Example 17, a wheelchair comprises a chassis, and a stand-up unit operably coupled to the chassis. The stand-up unit comprises a parallelogram comprising upper and lower elongate levers and front and rear connecting levers, wherein the parallelogram is moveable between a sitting position and a standing position, a two-piece coupling lever, a seat comprising an elongate coupling track fixedly attached at a proximal portion of the seat, wherein the coupling structure is moveably coupled to the elongate coupling track such that the coupling structure can move along a length of the elongate coupling track, a support operably coupled to the front connecting lever, a footrest operably coupled to the support, and a backrest operably coupled to the parallelogram. The two-piece coupling lever comprises a first link comprising a first end and a second end, wherein the first link is rotatably coupled to the rear connecting lever at the first end of the first link, a second link comprising a first end and a second end, a rotatable joint disposed at the second end of the first link and the second end of the second link, such that the first and second links are rotatably coupled via the rotatable joint, and a coupling structure attached to the first end of second link.

Example 18 relates to the wheelchair according to Example 17, wherein the seat is substantially parallel with the upper elongate lever in the sitting position, and wherein the seat is disposed at an angle in relation to the upper elongate lever in the standing position, wherein the seat being disposed at the angle allows a user to stand with a natural hip tilt.

Example 19 relates to the wheelchair according to Example 17, wherein the coupling structure is disposed at or near a proximal end of the elongate coupling track when the parallelogram is in the sitting position, such that the seat is substantially parallel with the upper elongate lever in the sitting position.

Example 20 relates to the wheelchair according to Example 17, wherein the coupling structure is disposed at or near a distal end of the elongate coupling track when the parallelogram is in the standing position, such that the seat is disposed at an angle in relation to the upper elongate lever in the standing position.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

The various embodiments herein relate to a stand-up unit for use in various wheelchairs, therapy chairs, and any other types of chairs, furniture, or other such devices in which a user can benefit from an apparatus that can assist the user in moving between sitting and standing positions.

Figure 1:
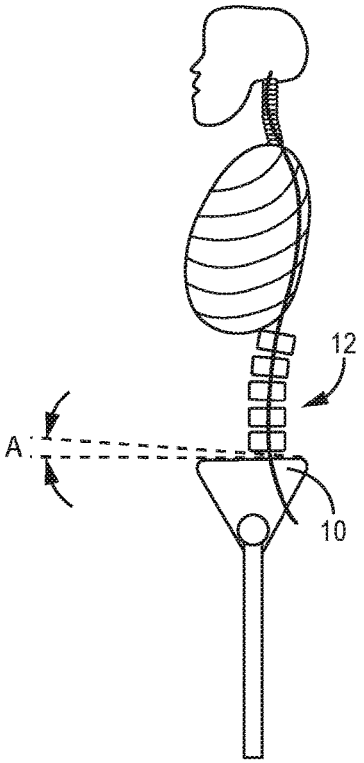
FIG. 1 is a schematic view of a skeleton of a human being exhibiting the natural hip tilt that typically occurs when standing.

As mentioned above in the Background, known stand-up units create a slightly tilted, single plane of support for the user when in the standing configuration. However, as depicted in FIG. 1, when a person stands without the assistance of a therapy chair or wheelchair, her/his hips and pelvis 10 rotate or tilt slightly forward at an angle A in relation to the horizon as shown, which creates the small arch 12 in the lower back as also shown that naturally occurs in the standing position. This is called the "hip flex" or "hip tilt." Because of the single plane of support in known stand-up units, the hips and pelvis of the user of such a unit does not rotate in the natural fashion depicted in FIG. 1, thereby preventing the user from standing in the most natural position with this hip flex.

In contrast, the various stand-up unit embodiments disclosed or contemplated herein provide a "hip flex adjustment" feature that adds a tilt capability to the seat carrier, thereby allowing the user's hips and pelvis to tilt forward slightly in the natural hip flex fashion, while allows the user to experience a physiologically correct posture that is more comfortable and beneficial while utilizing the stand-up unit implementations herein.

Figure 2:
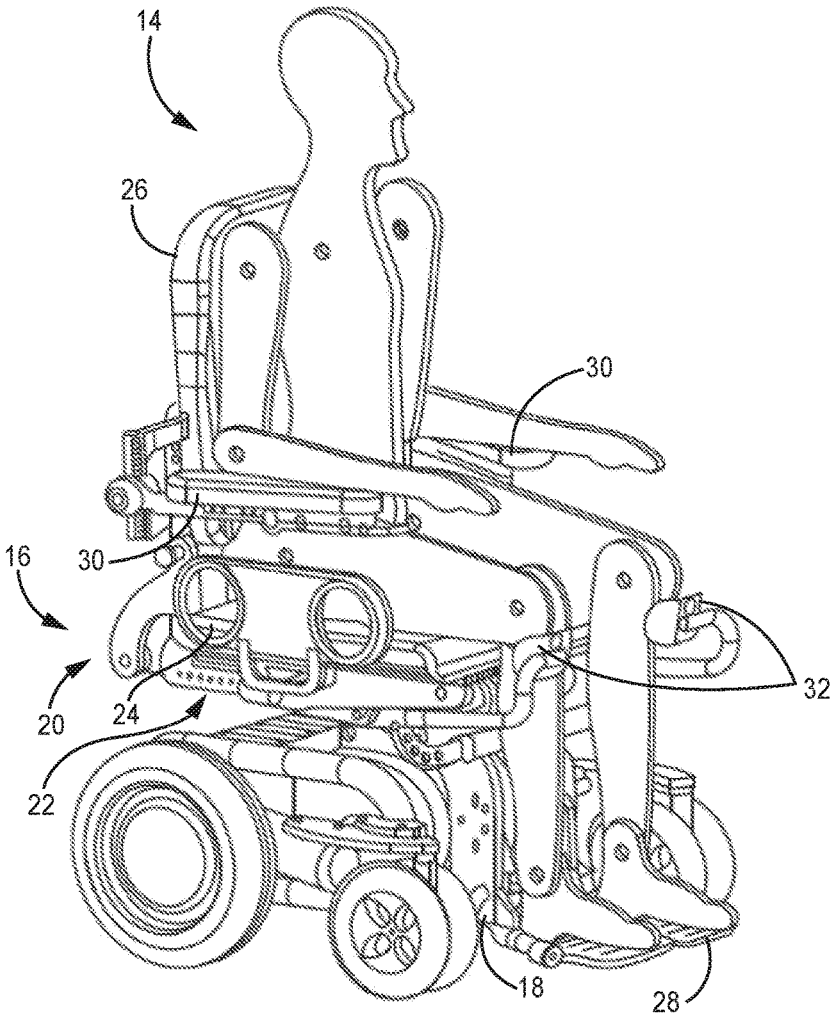
FIG. 2 is a perspective view of a wheelchair having a stand-up unit, according to one embodiment.

One such exemplary, known wheelchair 14 is depicted in FIG. 2, according to one embodiment. This wheelchair 14 has a stand-up unit 16 according to one embodiment, wherein the stand-up unit 16 has a base support 18 and a stand-up frame (or "mount") 20 articulated to the support 18. The stand-up mount 20 in this embodiment has two side frames 22 (of which only one frame 22 is visible in the view of FIG. 2) such that the seat 24, backrest 26 and footrest 28 are arranged between the two side frames 22. Further, the wheelchair 14 also has armrests 30 fastened to the backrest 26, as well as knee holders 32. The side frames 22 have a large number of levers which are illustrated schematically in FIG. 2. It would, however, also be possible to centrally arrange a single lever system of this type.

It is understood that this exemplary wheelchair 14 is only one type of device that can incorporate a stand-up unit according to the various embodiments disclosed or contemplated herein. Any other known stand-up wheelchair or apparatus of any configuration can incorporate the stand-up unit technology discussed in detail herein.

Figure 3A:
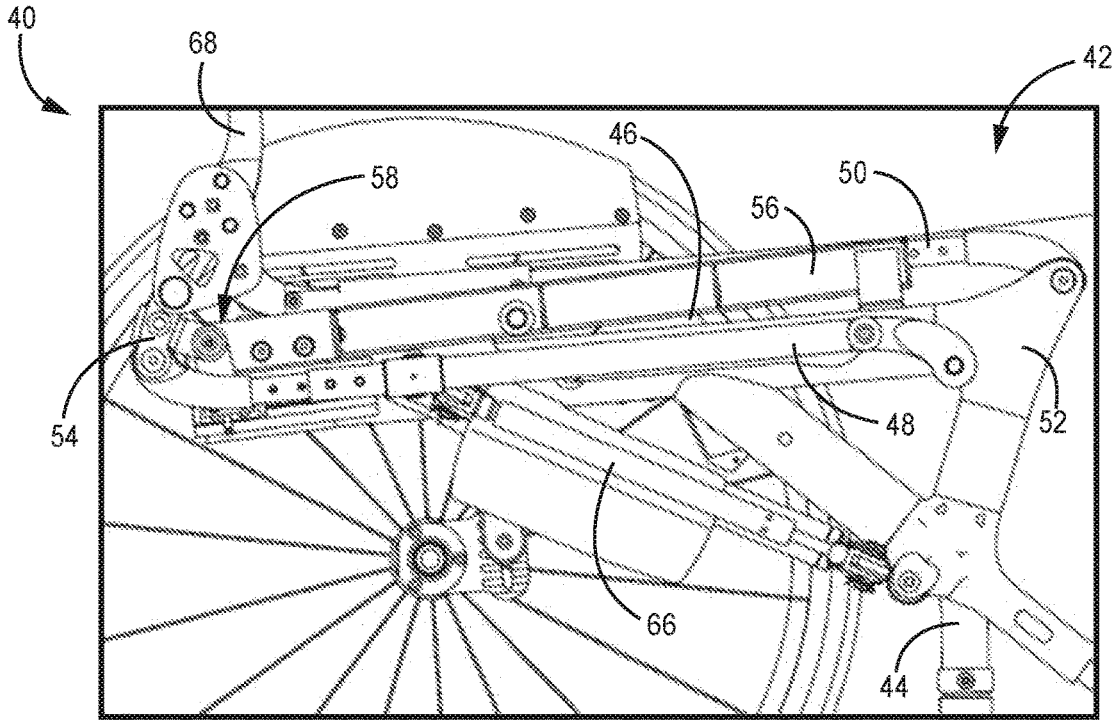
FIG. 3A is a side view of a stand-up unit in the sitting position, according to one embodiment.
Figure 3B:
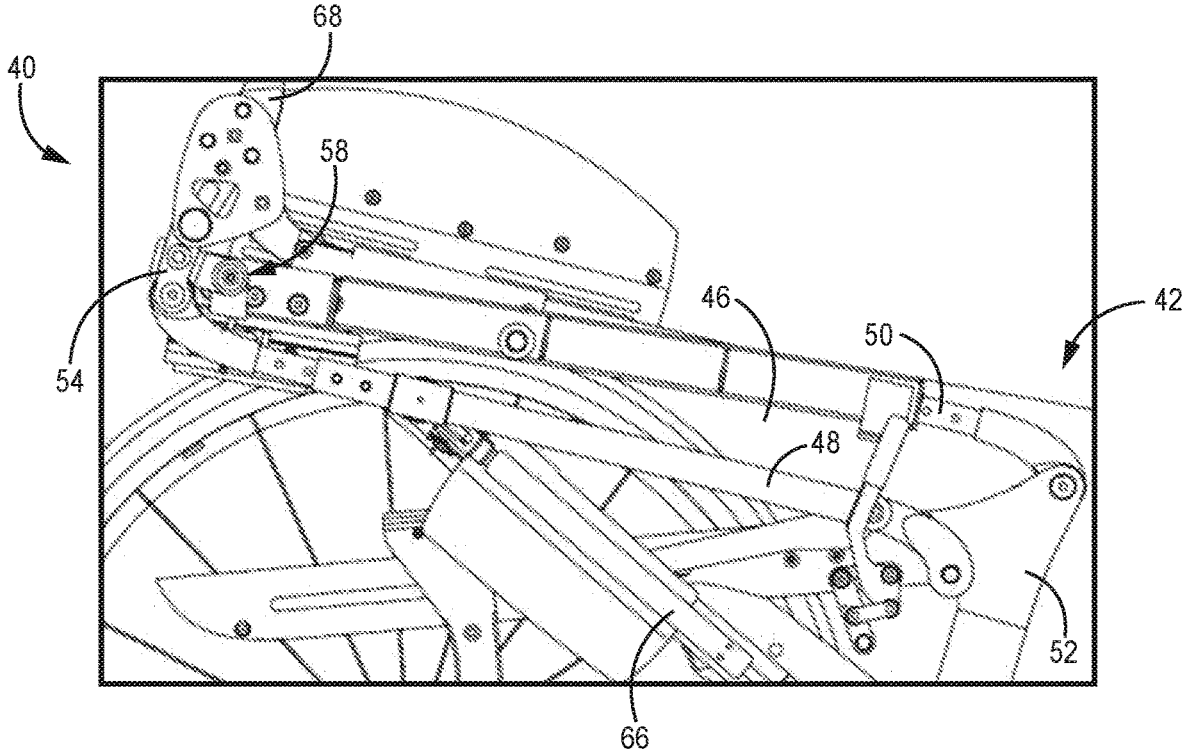
FIG. 3B is a side view of the stand-up unit of FIG. 3A as it transitions towards the standing position, according to one embodiment.
Figure 3C:
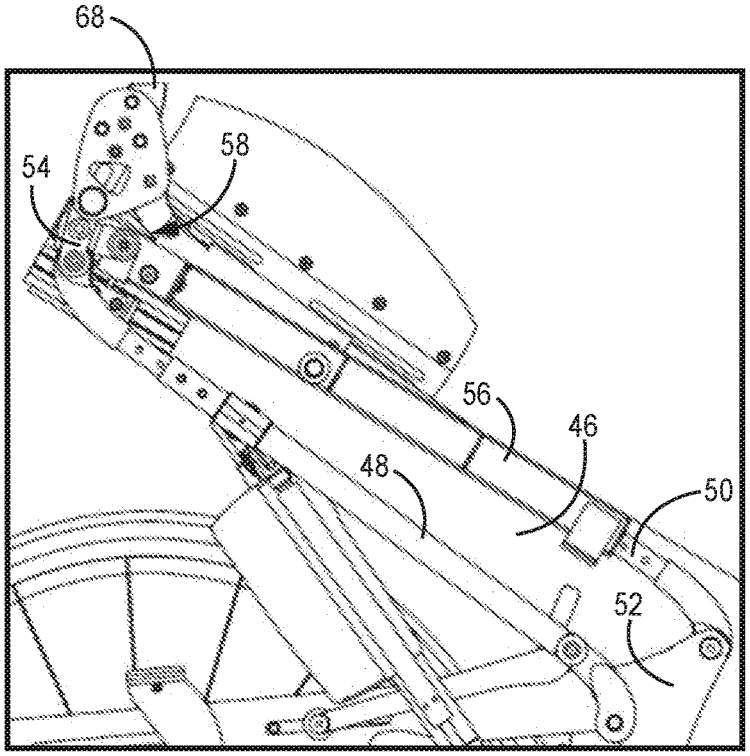
FIG. 3C is a side view of the stand-up unit of FIG. 3A as it moves closer to the standing position, according to one embodiment.
Figure 3D:
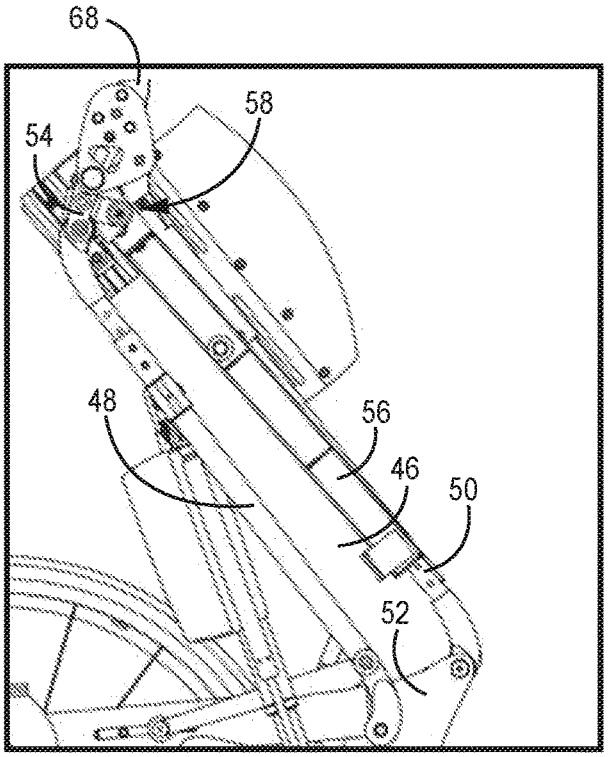
FIG. 3D is a side view of the stand-up unit of FIG. 3A as it moves even closer to the standing position, according to one embodiment.
Figure 3E:
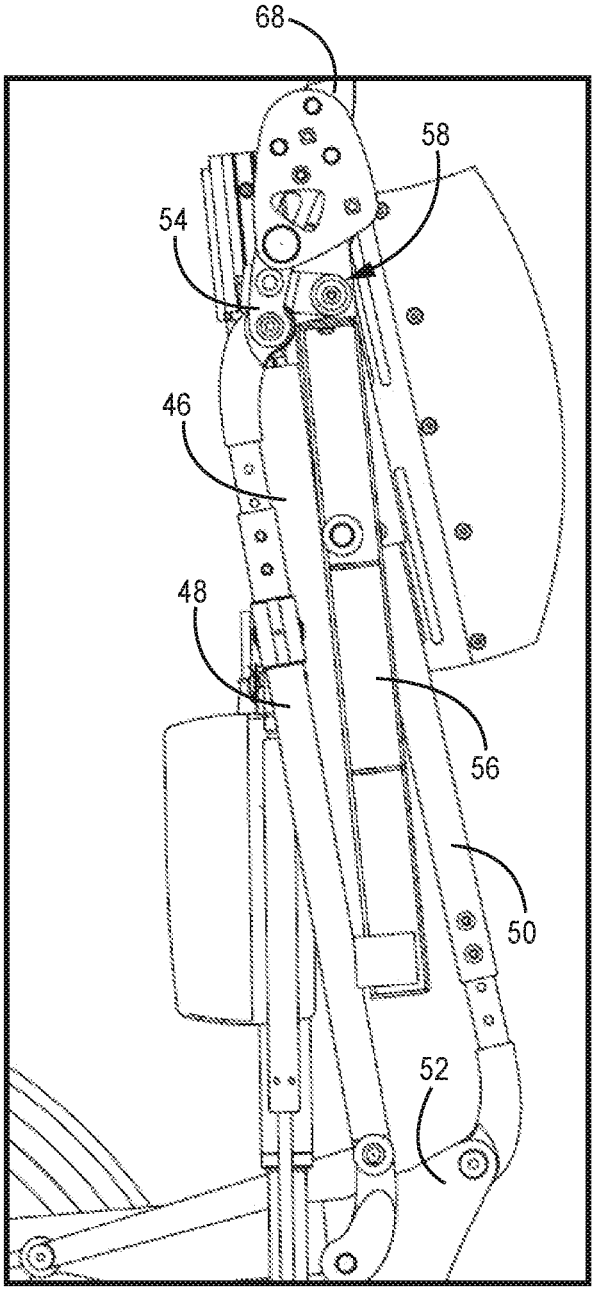
FIG. 3E is a side view of the stand-up unit of FIG. 3A in the standing position, according to one embodiment.
Figure 5A:
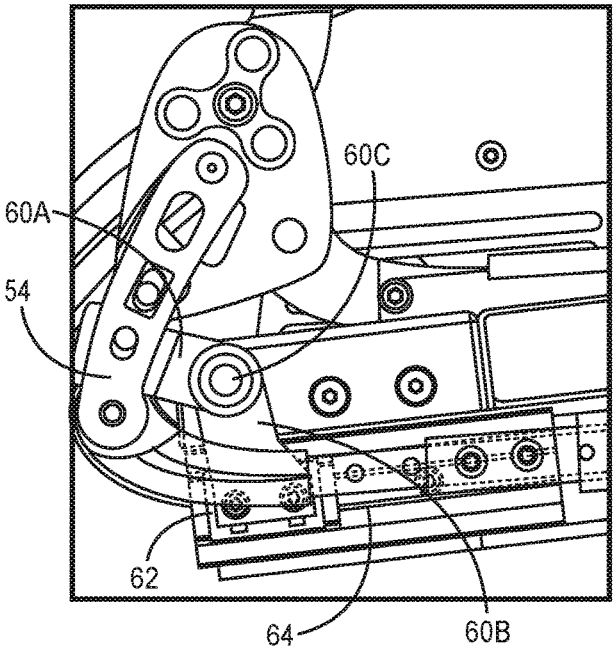
FIG. 5A is an expanded side view of the hinged lever of FIG. 4 in which the stand-up unit is in the sitting position, according to one embodiment.
Figure 5B:
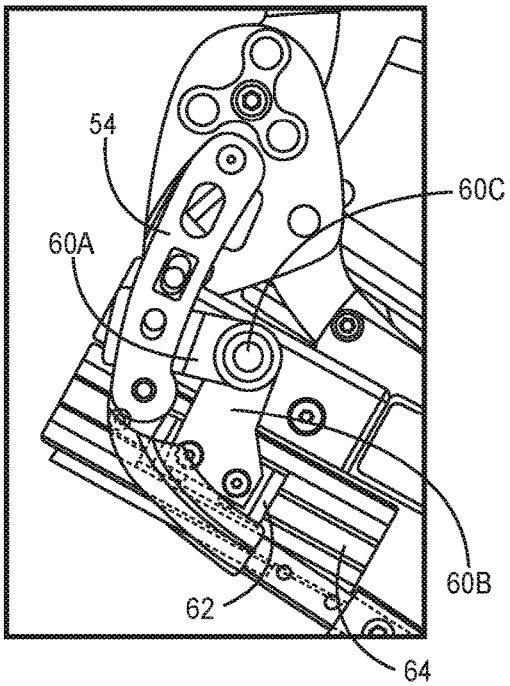
FIG. 5B is an expanded side view of the hinged lever of FIG. 4 as the stand-up unit transitions toward the standing position, according to one embodiment.
Figure 5C:
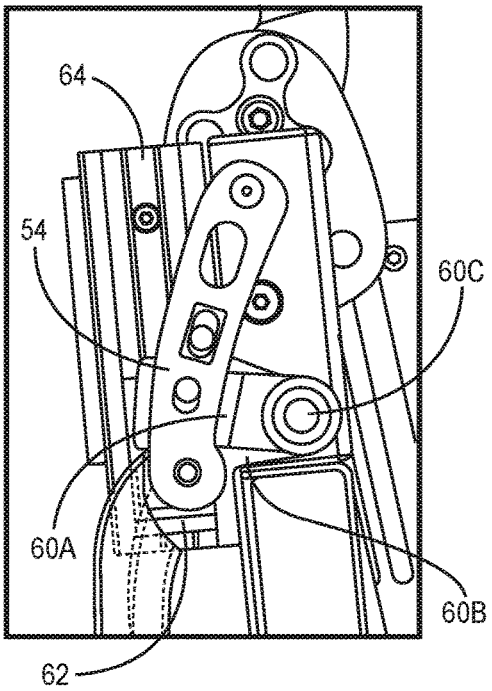
FIG. 5C is an expanded side view of the hinged lever of FIG. 4 in which the stand-up unit is in the standing position, according to one embodiment.

One embodiment of a stand-up system 40 is depicted in the schematic illustrations in FIGS. 3A-3E, which show the sequence of movement of the system 40 from the sitting position (as best shown in FIG. 3A) to the standing position (as best shown in FIG. 3E), with FIGS. 3B-3D depicting various stages therebetween. Further, FIGS. 5A-5C depict the sequence of movement of the hinged lever 58 (discussed below) in relation to the connecting lever 54 and the slide track 64 as the system 40 moves from the sitting position (as best shown in FIG. 5A) to the standing position (as best shown in FIG. 5C), as will be discussed in further detail below. It is understood that, according to certain implementations, the system 40 has several components substantially similar or identical to those in the stand-up unit embodiments disclosed in U.S. Published Application 2016/0302984, which is hereby incorporated herein by reference in its entirety. Certain components that differ from those embodiments in the incorporated application will be described in substantial detail herein.

The stand-up system 40 according to one embodiment has a stand-up assembly 42 that is moveably coupled to a support 44. The assembly 42 has at least a first parallelogram 46, which is made up of four levers 48, 50, 52, 54, with two elongate, substantially parallel levers 48, 50 and two shorter connecting levers 52, 54 coupled at each end of the elongate levers 48, 50 as shown. The four levers 48, 50, 52, 54 are rotatably coupled to each other such that the two elongate levers 48, 50 remain substantially parallel to each other as the unit 40 moves between the sitting configuration of FIG. 3A and the standing configuration of FIG. 3E.

In this embodiment, the seat carrier (also referred to herein as a "seat") 56 is a separate component that is indirectly coupled to the parallelogram 46 via a hinged, two-piece lever 58 as shown in FIGS. 3A-3E such that the seat carrier 56 rotates independently of the elongate lever 50, thereby allowing the seat carrier 56 to "tilt" in relation to the elongate lever 50 as the unit 40 moves into the stand-up configuration, thereby providing the desired "hip flex" for the user. In contrast, in previous stand-up systems, the seat carrier 56 would be directly coupled to or would be an inherent part of the elongate lever 50 (and would not be capable of independent rotation or tilt) such that the seat carrier 56 would form a single plane as described above, thereby preventing the user from experiencing the natural hip tilt described above.

Figure 4:
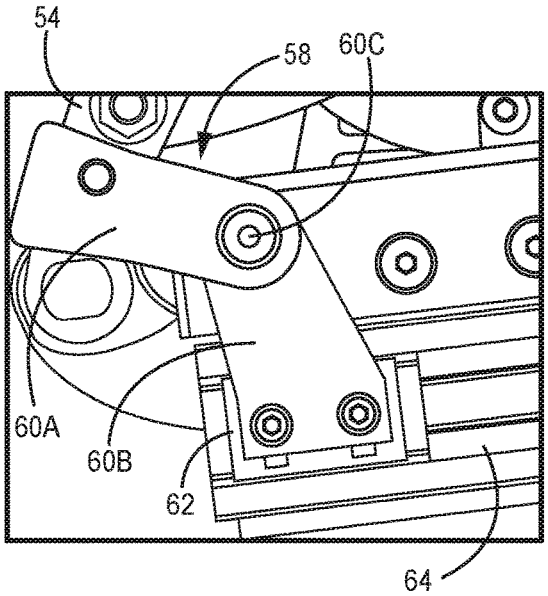
FIG. 4 is an expanded side view of a hinged lever, according to one embodiment.

An expanded view of the hinged lever 58 coupled to the parallelogram 46 and the seat carrier 56 is provided in FIG. 4. The hinged lever 58 consists of two links 60A, 60B that are rotatably coupled to each other via a lever joint 60C, and the lever 58 couples the seat carrier 56 to the connecting lever 54 as follows. The second link 60B has a substantially rectangular structure (also referred to herein as a "slidable insert") 62 attached thereto. The hinged lever 58 is coupled at the first link 60A to the connecting lever 54 and at the second link 60B to the seat carrier 56. More specifically, the seat carrier 56 has a slide track 64 fixedly coupled to a proximal end of the seat carrier 56 as shown. The slideable insert 62 of the second link 60B is slideably coupled to the slide track 64 such that the insert 62 is slideable along the length of the slide track 64 during the transition of the stand-up assembly 42 between the sitting and standing configurations as best shown in FIG. 5A-5C and as will be discussed in further detail below.

It is understood that the hinged lever according to the embodiments herein (including hinged lever 58) can be any two structures, such as rods, elongate structures, or any other such members, that can be rotatably coupled to each other while also being coupled to the stand-up unit as described herein. Further, it is also understood that the coupling structure or insert (such as structure 62) need not be a rectangular structure or slidable. Instead, the coupling structure can be any such structure, including a wheel (or two or more wheels) or any other member that can be coupled to the elongate coupling member (such as track 64) such that the coupling structure can move along the length of the elongate coupling member. In addition, it is also understood that the elongate coupling structure (such as the track 64) need not be limited to the track disclosed in further detail below. Instead, the elongate coupling structure can be any such elongate structure, including a structure that can receive or couple with any type of coupling structure (including a wheel or the like) such that the coupling structure can move along the length of the elongate coupling member.

Returning to FIGS. 3A-3E, in one embodiment, the system 40 is provided with a linear power unit (also referred as a "linear drive") 66 that is coupled at one end to the parallelogram 46 and at the other end to the support 44 such that the drive 66 can power the movement of the assembly 42 between the sitting and standing positions. A gas spring or another spring device, which compensates for the body weight of the user of the chair, can be provided in addition to the linear drive 66. Alternatively, certain embodiments in which the chair user has sufficient muscular strength do not have a linear drive.

Further, the stand-up unit 40 has a backrest 68 extending from the parallelogram 46 as shown in FIGS. 3A-3E. Further, the stand-up unit 40 can also have a footrest (not shown) coupled to a distal end of the support 44. It is understood that the parallelogram 46 operates in conjunction with the seat 56 and the backrest 68 in a known relationship (as disclosed in U.S. Published 2016/0302984, which is incorporated herein above) to ensure that the backrest 68 remains at substantially the same angle during the transition between the sitting position and the standing position as described herein.

In use, the stand-up unit 40 moves between the sitting configuration (as best shown in FIGS. 3A and 5A) and the standing configuration (as best shown in FIGS. 3E and 5C) in the following fashion. In the sitting configuration as best shown in FIG. 3A, the two elongate levers 48, 50 are substantially horizontal. Further, as best shown in FIG. 5A, the hinged lever 58 is positioned such that the slidable insert 62 is disposed at the proximal end of the slide track 64. As the stand-up assembly 42 begins to move toward the standing configuration as shown in FIGS. 3B-3D and FIG. 5B, the movement of the connecting lever 54 causes the hinged lever 58 to move such that the slidable insert 62 begins to move distally along the track 64. For example, in FIGS. 3C and 5B, the slidable insert 62 is disposed at or near a midpoint of the track 64. And as the slidable insert 62 moves along the track 64 in this fashion, the hinged lever 58 also causes the seat carrier 56 to rotate independently of the lever 50, as best shown in FIGS. 3C to 3E. More specifically, as the assembly 42 approaches the standing configuration, the distal end of the seat carrier 56 begins to move away from the lever 50, thereby resulting in an additional tilt of the seat carrier 56 that urges the hips of the user into a "flexed" position.

Figure 6A:
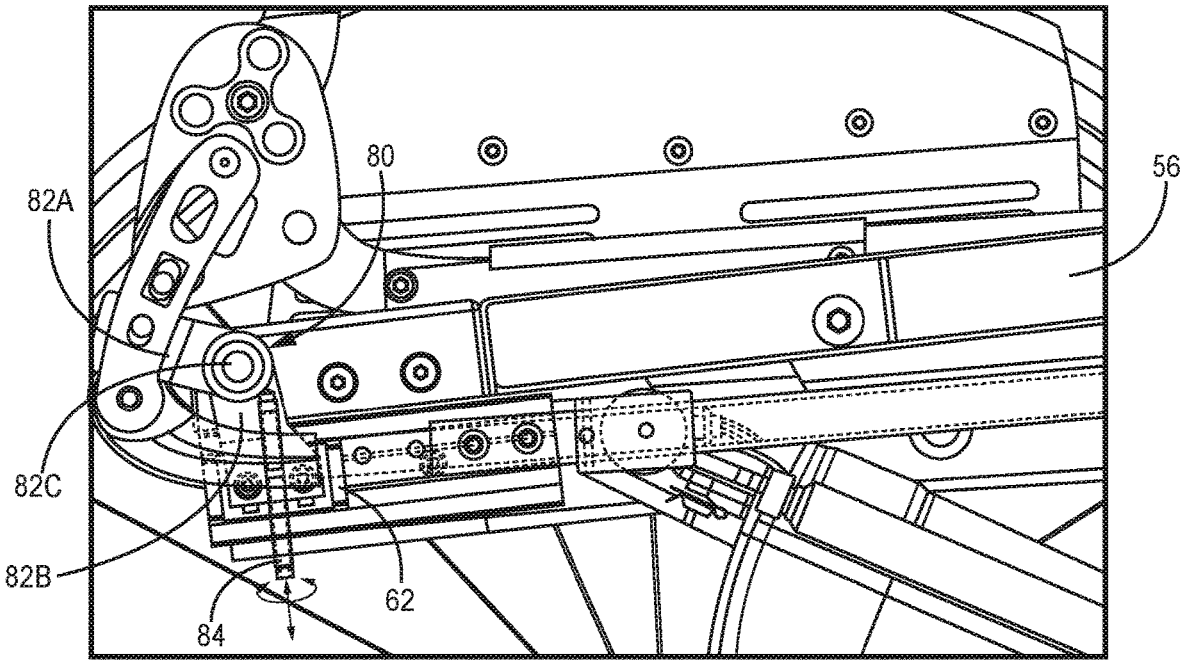
FIG. 6A is a side view of a stand-up unit with another hinged lever, according to another embodiment.
Figure 6B:
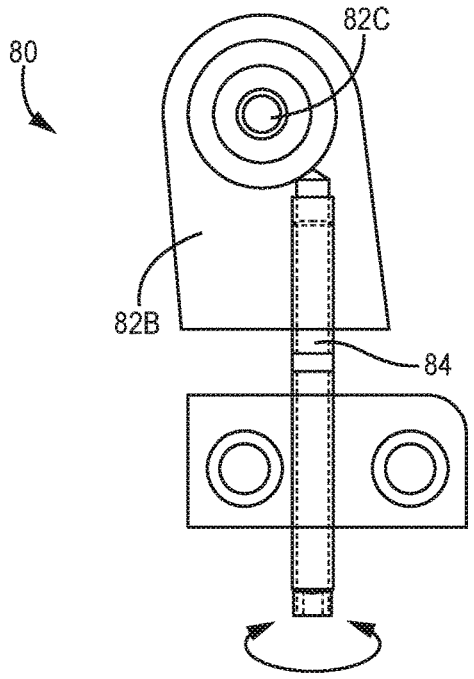
FIG. 6B is an expanded side view of a portion of the hinged lever of FIG. 6A, according to one embodiment.

In an alternative embodiment as depicted in FIGS. 6 and 6B, a hinged lever 80 is provided that is adjustable to allow for "micro" adjustments to the tilt of the seat carrier 56 in the standing configuration. More specifically, the second link 82B of the lever 80 can have a rotatable adjustment mechanism (also referred to as a "rotatable peg") 84 that can be used to adjust the distance of the slidable insert 62 from the joint 82C. Rotation of the peg 40 in one direction causes the insert 62 to move farther from the joint 82C, while rotation in the other direction causes the insert 62 to move closer to the joint 82C. This adjustment causes the amount of tilt of the seat carrier 56 to be adjusted by the same amount, thereby allowing a user to make small adjustments to the amount of hip flex provided by the assembly 42.

According to a further alternative, the slide track 64 can be coupled directly to the lever 50, thereby allowing for the lever 50 to tilt in relation to the rest of the parallelogram 46 and providing the desired hip flex (rather than including a separate seat carrier).

In certain embodiments, the seat carrier 56 can be a rigid component made of metal or any other rigid material. Alternatively, the seat carrier 56 can be made of a soft, pliable, and/or flexible material such as a fabric or any other known material having soft, pliable, and/or flexible characteristics.

It is understood that this "hip flex" feature can be incorporated into most known stand-up units.

Although the present invention has been described with reference to preferred embodiments, persons skilled in the art will recognize that changes may be made in form and detail without departing from the spirit and scope of the invention.

What is claimed is:

1. A stand-up unit, comprising:

(a) a parallelogram comprising first and second elongate levers and first and second connecting levers;

(b) a hinged lever comprising (i) a first link rotatably coupled to the first connecting lever at a first end of the first link;

(ii) a second link rotatably coupled at a first end of the second link to a second end of the first link via a hinged lever joint; and (iii) a coupling structure attached to a second end of the second link;

(c) a seat comprising a coupling track operably coupled to the seat; and (d) a support operably coupled to the second connecting lever, wherein the coupling structure is slidably coupled to the coupling track.

2. The stand-up unit of claim 1, wherein the parallelogram comprises a sitting position and a standing position, wherein the parallelogram is moveable between the sitting and standing positions.

3. The stand-up unit of claim 2, wherein the seat is substantially parallel with the first elongate lever in the sitting position.

4. The stand-up unit of claim 3, wherein the seat is disposed at an angle in relation to the first elongate lever in the standing position, wherein the seat being disposed at the angle allows a user to stand with a natural hip tilt.

5. The stand-up unit of claim 2, wherein the coupling structure is disposed at or near a proximal end of the coupling track when the parallelogram is in the sitting position.

6. The stand-up unit of claim 5, wherein the seat is substantially parallel with the first elongate lever in the sitting position as a result of the coupling structure being disposed at or near the proximal end of the coupling track.

7. The stand-up unit of claim 2, wherein the coupling structure is disposed at or near a distal end of the coupling track when the parallelogram is in the standing position.

8. The stand-up unit of claim 7, wherein the seat is disposed at an angle in relation to the first elongate lever in the standing position as a result of the coupling structure being disposed at or near the distal end of the coupling track.

9. The stand-up unit of claim 1, wherein the stand-up unit is incorporated into a wheelchair or a therapy chair.

10. A stand-up unit, comprising:

(a) a parallelogram comprising upper and lower elongate levers and front and rear connecting levers, wherein the parallelogram is moveable between a sitting position and a standing position;

(b) a two-piece coupling lever comprising (i) a first link comprising a first end and a second end, wherein the first link is rotatably coupled to the rear connecting lever at the first end of the first link;

(ii) a second link comprising a first end and a second end, (iii) a rotatable joint disposed at the second end of the first link and the second end of the second link, such that the first and second links are rotatably coupled via the rotatable joint; and (iv) a coupling structure attached to the first end of the second link;

(c) a seat comprising an elongate coupling track fixedly attached at a proximal portion of the seat, wherein the coupling structure is moveably coupled to the elongate coupling track such that the coupling structure can move along a length of the elongate coupling track; and (d) a support operably coupled to the front connecting lever.

11. The stand-up unit of claim 10, wherein the seat is substantially parallel with the upper elongate lever in the sitting position.

12. The stand-up unit of claim 10, wherein the seat is disposed at an angle in relation to the upper elongate lever in the standing position, wherein the seat being disposed at the angle allows a user to stand with a natural hip tilt.

13. The stand-up unit of claim 10, wherein the coupling structure is disposed at or near a proximal end of the elongate coupling track when the parallelogram is in the sitting position.

14. The stand-up unit of claim 13, wherein the seat is substantially parallel with the upper elongate lever in the sitting position as a result of the coupling structure being disposed at or near the proximal end of the elongate coupling track.

15. The stand-up unit of claim 10, wherein the coupling structure is disposed at or near a distal end of the elongate coupling track when the parallelogram is in the standing position.

16. The stand-up unit of claim 15, wherein the seat is disposed at an angle in relation to the upper elongate lever in the standing position as a result of the coupling structure being disposed at or near the distal end of the elongate coupling track.

17. A wheelchair comprising:

(a) a chassis; and (b) a stand-up unit operably coupled to the chassis, the stand-up unit comprising:

a parallelogram comprising upper and lower elongate levers and front and rear connecting levers, wherein the parallelogram is moveable between a sitting position and a standing position;

(ii) a two-piece coupling lever comprising (A) a first link comprising a first end and a second end, wherein the first link is rotatably coupled to the rear connecting lever at the first end of the first link;

(B) a second link comprising a first end and a second end, (C) a rotatable joint disposed at the second end of the first link and the second end of the second link, such that the first and second links are rotatably coupled via the rotatable joint; and (D) a coupling structure attached to the first end of the second link;

(iii) a seat comprising an elongate coupling track fixedly attached at a proximal portion of the seat, wherein the coupling structure is moveably coupled to the elongate coupling track such that the coupling structure can move along a length of the elongate coupling track;

(iv) a support operably coupled to the front connecting lever;

(v) a footrest operably coupled to the support; and (vi) a backrest operably coupled to the parallelogram.

18. The wheelchair of claim 17, wherein the seat is substantially parallel with the upper elongate lever in the sitting position, and wherein the seat is disposed at an angle in relation to the upper elongate lever in the standing position, wherein the seat being disposed at the angle allows a user to stand with a natural hip tilt.

19. The wheelchair of claim 17, wherein the coupling structure is disposed at or near a proximal end of the elongate coupling track when the parallelogram is in the sitting position, such that the seat is substantially parallel with the upper elongate lever in the sitting position.

20. The wheelchair of claim 17, wherein the coupling structure is disposed at or near a distal end of the elongate coupling track when the parallelogram is in the standing position, such that the seat is disposed at an angle in relation to the upper elongate lever in the standing position.

* * * * *